US010989023B2

(12) United States Patent
MacGillivray et al.

(10) Patent No.: US 10,989,023 B2
(45) Date of Patent: Apr. 27, 2021

(54) SEALED BALLISTIC TRANSFER APPARATUS

(71) Applicant: Halliburton Energy Services, Inc., Houston, TX (US)

(72) Inventors: Joseph MacGillivray, Fort Worth, TX (US); Richard Robey, Mansfield, TX (US); Nicholas Harrington, Midlothian, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/321,800

(22) PCT Filed: Nov. 14, 2017

(86) PCT No.: PCT/US2017/061564
§ 371 (c)(1),
(2) Date: Jan. 29, 2019

(87) PCT Pub. No.: WO2019/098995
PCT Pub. Date: May 23, 2019

(65) Prior Publication Data

US 2020/0277843 A1 Sep. 3, 2020

(51) Int. Cl.
*E21B 43/119* (2006.01)
*E21B 43/117* (2006.01)

(52) U.S. Cl.
CPC ..... *E21B 43/119* (2013.01); *E21B 43/117* (2013.01)

(58) Field of Classification Search
CPC .... E21B 43/116; E21B 43/117; E21B 43/119; E21B 43/11
(Continued)

(56) References Cited

U.S. PATENT DOCUMENTS 5,155,293 A * 10/1992 Barton ..... C06C 5/06 102/312
6,397,752 B1 * 6/2002 Yang ..... E21B 43/1185 102/275.4
(Continued)

FOREIGN PATENT DOCUMENTS

WO 2005008026 1/2005
WO 2012106640 8/2012

OTHER PUBLICATIONS

J. Hale and C.C. Quattlebaum, New Carrier Method for Propellants Offers Flexibility, Simplicity, and Performance, SPE 115650, 2008.
(Continued)

*Primary Examiner* — John Cooper
(74) *Attorney, Agent, or Firm* — John Wustenberg; C. Tumey Law Group PLLC

(57) ABSTRACT

This disclosure may generally relate to subterranean operations. A ballistic transfer apparatus may include a detonation transfer line, wherein the detonation transfer line comprises a first end and a second end; a first holder in engagement with the first end of the detonation transfer line to retain the detonation transfer line in the ballistic transfer apparatus; a second holder in engagement with the second end of the detonation transfer line to retain the detonation transfer line in the ballistic transfer apparatus; and a shroud extending between the first holder and the second holder that covers the detonation transfer line.

20 Claims, 3 Drawing Sheets

(58) Field of Classification Search
USPC ..... 89/1.15, 1.151
See application file for complete search history.

(56) References Cited

U.S. PATENT DOCUMENTS

| | | | | |
|---|---|---|---|---|
| 7,213,655 | B2 * | 5/2007 | Parrott | E21B 43/11 166/380 |
| 2005/0183610 | A1 | 8/2005 | Barton et al. | |
| 2007/0034381 | A1 * | 2/2007 | Campbell | E21B 43/116 166/378 |
| 2011/0024116 | A1 * | 2/2011 | McCann | E21B 43/1185 166/297 |

OTHER PUBLICATIONS

Halliburton: Perforating Solutions, Well Stimulation Tool, p. 214, Jul. 2017, available on the Internet at https://www.halliburton.com/content/dam/ps/public/lp/contents/Books_and_Catalogs/web/JRC_Catalog/Perforating-Solutions.pdf.

International Search Report and Written Opinion for Application No. PCT/US2017/061564 dated Sep. 3, 2018.

* cited by examiner

SEALED BALLISTIC TRANSFER APPARATUS

BACKGROUND

After drilling various sections of a subterranean wellbore that traverses a formation, a casing string may be positioned and cemented within the wellbore. This casing string may increase the integrity of the wellbore and may provide a path for producing fluids from the producing intervals to the surface. To produce fluids into the casing string, perforations may be made through the casing string, the cement, and a short distance into the formation.

These perforations may be created by detonating a series of shaped charges that may be disposed within the casing string and may be positioned adjacent to the formation. Specifically, one or more perforating guns may be loaded with shaped charges that may be connected with a detonator via a detonating cord. The perforating guns may then be attached to a tool string that may be lowered into the cased wellbore. Once the perforating guns are properly positioned in the wellbore such that the shaped charges are adjacent to the formation to be perforated, the shaped charges may be detonated, thereby creating the desired perforations.

When an array of perforating guns is utilized, there is a gap between them that the detonation transfer line runs along. Previous devices and methods may leave the detonation transfer line partially exposed to the wellbore environment. This may lead to disconnection between the devices, misfires, or early detonations. These devices and methods include creating seals using the detonation transfer line itself, which is unreliable as the detonation transfer line may shrink under pressure.

BRIEF DESCRIPTION OF THE DRAWINGS

These drawings illustrate certain aspects of some examples of the present disclosure, and should not be used to limit or define the disclosure.

DETAILED DESCRIPTION

This disclosure may generally relate to subterranean operations. More particularly, systems and methods may be provided for protecting detonation transfer line from the wellbore environment. Perforating systems and methods that use a ballistic transfer apparatus may enhance safety in all aspects of perforating activities by preventing misfires, early detonations, and contamination from the surrounding wellbore environment.

Figure 1:
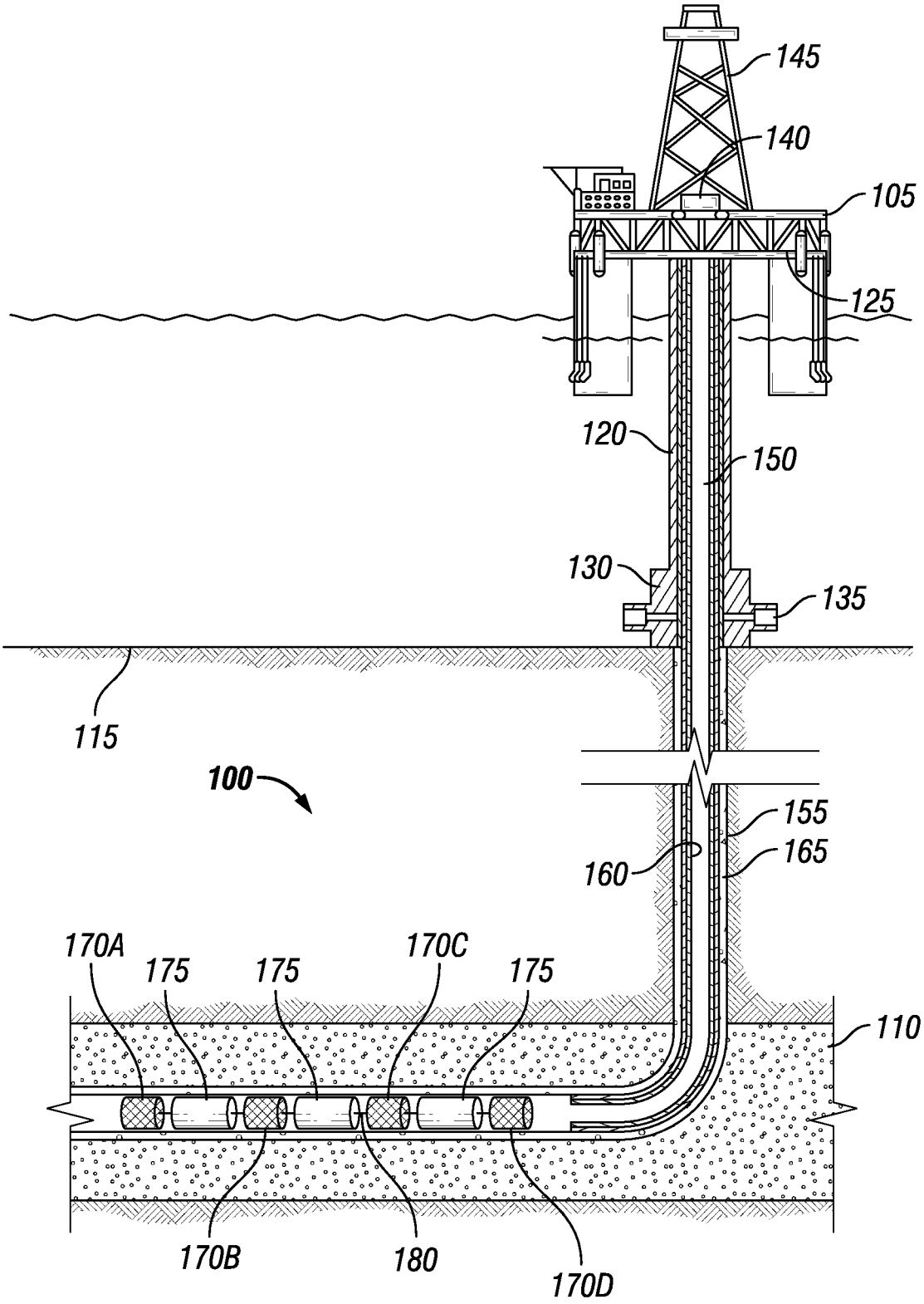
FIG. 1 illustrates an embodiment of a downhole system.

FIG. 1 illustrates an example of a downhole perforating system 100 operating from a platform 105. Platform 105 may be centered over a subterranean formation 110 located below the surface 115. A conduit 120 may extend from deck 125 of platform 105 to wellhead installation 130 including blow-out preventers 135. Platform 105 may have a hoisting apparatus 140 and a derrick 145 for raising and lowering pipe strings, such as, for example, work string 150 which may include the downhole perforating system 100. As illustrated, the downhole perforating system 100 may be disposed on a distal end of work string 150. It should be noted that while FIG. 1 generally depicts a subsea operation, those skilled in the art will readily recognize that the principles described herein are equally applicable to land-based systems, without departing from the scope of the disclosure.

Wellbore 155 may extend through the various earth strata including subterranean formation 110. While downhole perforating system 100 is disposed in a horizontal section of wellbore 155, wellbore 155 may include horizontal, vertical, slanted, curved, and other types of wellbore geometries and orientations in which downhole perforating system 100 may be disposed, as will be appreciated by those of ordinary skill in the art. A casing 160 may be cemented within wellbore 155 by cement 165. When it is desired to perforate subterranean formation 110, the downhole perforating system 100 may be lowered through casing 160 until the downhole perforating system 100 is properly positioned relative to subterranean formation 110. The downhole perforating system 100 may be attached to and lowered via work string 150, which may include a tubing string, wireline, slick line, coil tubing or other conveyance. Upon detonation, components within downhole perforating system 100 may form jets that may create a spaced series of perforations extending outwardly through casing 160, cement 165 and into subterranean formation 110, thereby allowing formation communication between subterranean formation 110 and wellbore 155.

Downhole perforating system 100 may include one or more ballistic apparatuses 170*a*, 170*b*, 170*c*, 170*d*. The ballistic apparatus will be referred to herein collectively as ballistic apparatus 170*a*, 170*b*, 170*c*, 170*d* and individually as first ballistic apparatus 170*a*, second ballistic apparatus 170*b*, third ballistic apparatus 170*c*, and fourth ballistic apparatus 170*d*. Ballistic apparatuses 170*a*, 170*b*, 170*c*, 170*d* may be any device used in a perforating gun for perforating subterranean formation 110, as explained in further detail below. Without limitation, ballistic apparatuses 170*a*, 170*b*, 170*c*, 170*d* may individually be a firing head (e.g., firing head 200 on FIG. 2), a handling subassembly (e.g., handling subassembly 205 on FIG. 2), a gun subassembly (e.g. gun subassembly 210 on FIG. 2) and/or combinations thereof. Additional examples of ballistic apparatuses 170*a*, 170*b*, 170*c*, 170*d* may include, but are not limited to, tubing cutters and setting tools. Downhole perforating system 100 may also include a ballistic transfer apparatus 175, wherein the ballistic transfer apparatus 175 may connect two or more ballistic apparatuses 170*a*, 170*b*, 170*c*, 170*d*. In prior embodiments of downhole perforating system 100, a detonation transfer line 180 (explained in further detail on FIG. 2) would extend between and connect the ballistic apparatuses 170*a*, 170*b*, 170*c*, 170*d* to one another. There may be a need to protect at least a portion of detonation transfer line 180 that is exposed between the ballistic apparatuses 170*a*, 170*b*, 170*c*, 170*d* from the surrounding environment of wellbore 155. Implementation of ballistic transfer apparatus 175 may protect the at least a portion of detonation transfer line 180 from wellbore 155 and may create a pressure and liquid seal between ballistic apparatuses 170*a*, 170*b*, 170*c*, 170*d*. There may be a plurality of ballistic transfer apparatuses 175 disposed between ballistic apparatuses 170*a*, 170*b*, 170*c*, 170*d*. As illustrated, each of the ballistic transfer apparatuses 175 may individually form a sealed connection between first ballistic apparatus 170*a* and second ballistic apparatus 170*b*, between second ballistic apparatus 170*b* and third ballistic apparatus 170*c*, and between third ballistic apparatus 170*c* and fourth ballistic apparatus 170*d*.

Figure 2:
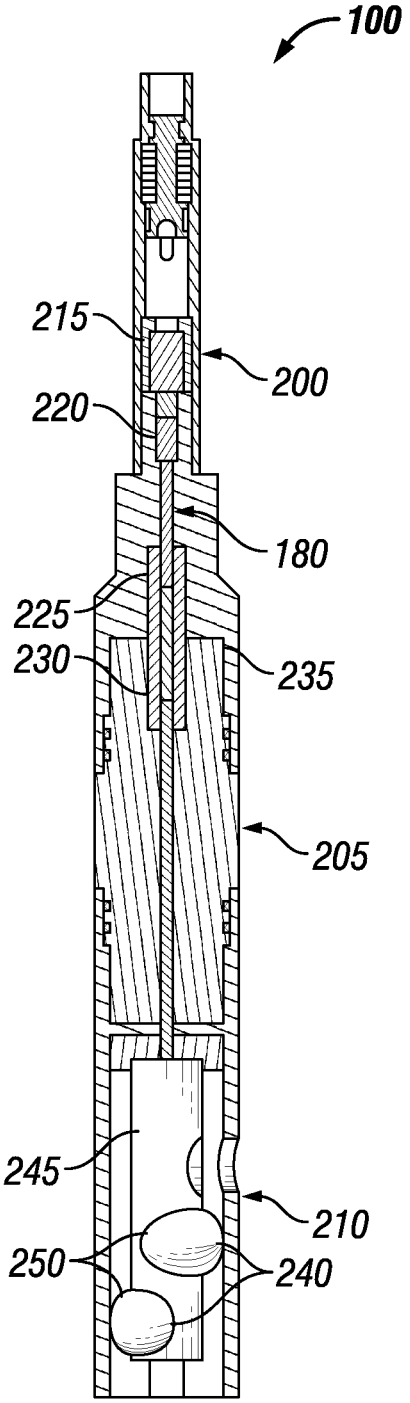
FIG. 2 illustrates an embodiment of a ballistic apparatus.

FIG. 2 illustrates an embodiment of downhole perforating system 100. As illustrated, firing head 200 may be disposed at an upper end of downhole perforating system 100. Handling subassembly 205 may be disposed between gun subassembly 210 and firing head 200. Handling subassembly 205 may be coupled to firing head 200 and gun subassembly 210 by any suitable means, such as, for example, mechanical fasteners, welds and/or threads. Firing head 200 may include ignition device 215. As illustrated, ignition device 215 may be disposed within at least a portion of firing head 200. Firing head 200 may include detonating cord initiator 220, detonation transfer line 180, and donor booster 225 (bi-directional booster). Detonation transfer line 180 may extend from detonating cord initiator 220 to gun subassembly 210. Handling subassembly 205 may include acceptor booster 230 (bi-directional booster) coupled to detonation transfer line 180. Detonation transfer line 180 may be discontinuous between donor booster 225 and acceptor booster 230. There may be air gap 235 between donor booster 225 and acceptor booster 230. Donor booster 225 and acceptor booster 230 may include compressed particles of an explosive component. Without limitation, the explosive component may include any suitable explosive material. The donor booster 225 may be capable of transmitting a detonation across a discontinuity such as an air gap 235. It does this by its own detonation, in response to a detonation of an adjacent secondary high explosive mass (e.g., detonation transfer line 180), the donor booster 225 detonation yielding a sufficiently high output to enable transmission across the air gap 235 or the like. Because of the output requirements, a donor booster 225 may include a secondary high explosive; such secondary boosters may not continue/allow a detonation over any discontinuity, for example, an air gap 235. This may mean that donor booster 225 and detonation transfer line 180 to which it is coupled may be in direct physical contact.

An acceptor booster 230, on the other hand, may be one which may detonate in response to another detonation, i.e., in response to the detonation of a donor booster 225 which may be spaced from the acceptor booster 230 by a discontinuity such as an air gap 235; the acceptor booster 230 may further be capable of detonating another secondary high explosive mass (e.g., detonation transfer line 180) in operative association with it by means of the acceptor booster's 230 own detonation. Thus, an acceptor booster 230 may continue/allow a detonation from a donor booster 225, even across a discontinuity, and may transmit the detonation to another secondary high explosive mass so as to continue/allow the detonation. Therefore, to continue/allow the detonation, an acceptor booster 230 may detonate, and not deflagrate.

Ignition device 215 may be coupled to detonating cord initiator 220 and may provide a substantial amount of the energy to ignite detonating cord initiator 220. A signal (e.g., electrical, mechanical, etc.) may be sent form the surface 115 (e.g., shown on FIG. 1) to activate ignition device 215, which may in turn ignite detonating cord initiator 220. Ignition device 215, may include, but is not limited to, a rig environment detonator igniter, industry standard resistor detonators, hotwire igniters, exploding bridgewire igniters, exploding foil initiator igniters, conductive mix igniters, percussion actuated igniters, and a high tension igniting system. Detonating cord initiator 220 may include compressed particles of an explosive component. Without limitation, the explosive component in detonating cord initiator 220 may include any suitable explosive material.

With continued reference to FIG. 2, gun subassembly 210 may be coupled to detonation transfer line 180. Detonation transfer line 180 may include compressed particles of an explosive component. Without limitation, the explosive component in detonation transfer line 180 may include any suitable explosive material. Gun subassembly 210 may include shaped charges 240. Ignition of detonation transfer line 180 by ignition device 215 may set off a shock wave that ignites shaped charges 240.

Gun subassembly 210 may include gun body 245. As illustrated, gun body 245 may be in the form of a cylindrical sleeve. Gun body 245 may include a plurality of charge holding recesses 250 which hold shaped charges 240. The plurality of shaped charges 240 may be arranged in a spiral pattern such that each of the shaped charges 240 may be disposed on its own level or height and may be individually detonated so that only one shaped charge 240 may be fired at a time. Alternate arrangements of the plurality of shaped charges 240 may be used, including cluster type designs wherein more than one shaped charge 240 may be at a same level and may be detonated at the same time. Upon ignition, shaped charges 240 may generate a jet that may penetrate casing 160, cement 165 and into subterranean formation 110, which are shown on FIG. 1, for example. In order to ensure a successful detonation, ballistic transfer apparatus 175 may be implemented in downhole perforating system 100, as described herein with respect to FIGS. 3-6.

Figure 3:
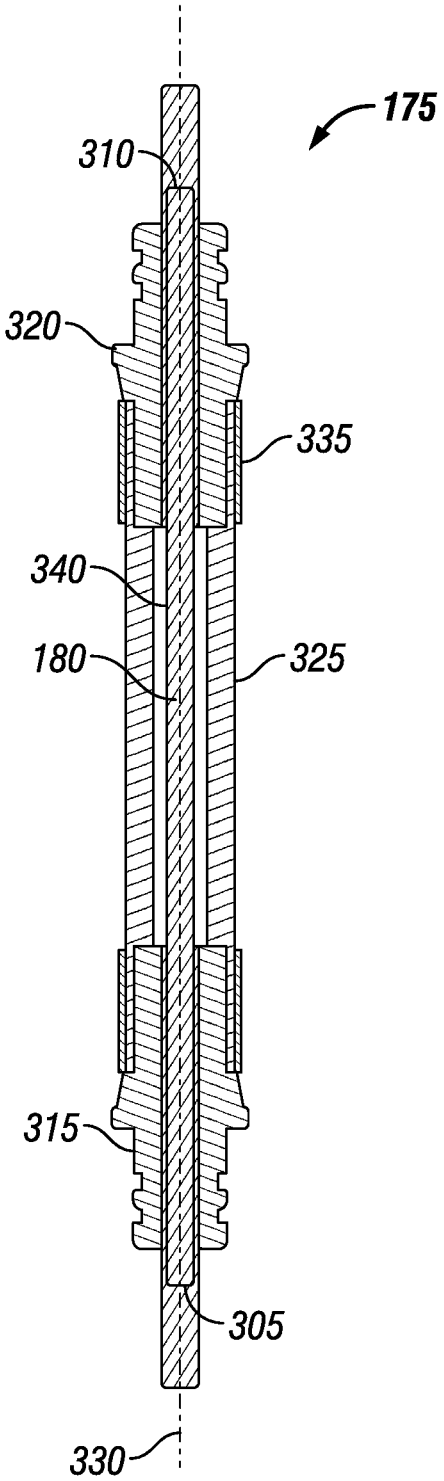
FIG. 3 illustrates an embodiment of a ballistic transfer apparatus.

FIG. 3 illustrates an embodiment of ballistic transfer apparatus 175. Ballistic transfer apparatus 175 may include a detonation transfer line 180 having a first end 305 and a second end 310. Ballistic transfer apparatus 175 may further include a first holder 315, a second holder 320, and a shroud 325. First holder 315 and second holder 320 may facilitate coupling of ballistic transfer apparatus 175 to adjacent ballistic apparatuses (e.g., first ballistic apparatus 170*a* and second ballistic apparatus 170*b* on FIG. 4). Shroud 325 may enclose detonation transfer line 180 to protect detonation transfer line 180 from the external environment.

Detonation transfer line 180 may be any suitable line for transferring detonation through the ballistic transfer apparatus. Suitable detonation transfer lines may include, but are not limited to, detonation cords, shock tubes, and detonating fuses among others. Detonation transfer line 180 may include an elongated body portion 340. Elongated body portion 340 may be a continuous line of material between two ends. First end 305 may be an end portion of detonation transfer line 180. Second end 310 may be an end portion of detonation transfer line 180 opposite to that of first end 305. First end 305 and second end 310 may be used interchangeably. First end 305 and second end 310 may include any suitable booster, for example, compressed particles of an explosive component. Depending on the particle type of detonation transfer line 180 used, booster in the first end 305 and second end 310 may not be needed. Without limitation, the explosive component in first end 305 and second end 310 may include any suitable explosive material. First end 305 or second end 310 may be disposed within either first holder 315 or second holder 320.

First holder 315 may be a device disposed toward one end of ballistic transfer apparatus 175. Second holder 320 may be a device disposed towards the opposite end of ballistic transfer apparatus 175 from first holder 315. First holder 315 and second holder 320 may be used interchangeably. First holder 315 and second holder 320 may secure either first end 305 or second end 310 in place as detonation transfer line 180 spans the length between first holder 315 and second holder 320. As illustrated, first holder 315 may be in engagement with first end 305 of detonation transfer line 180, and second holder 320 may be in engagement with second end 310 of detonation transfer line 180. Detonation transfer line 180 may be disposed along the longitudinal axis 330 of first holder 315 and/or second holder 320. First holder 315 and second holder 320 may secure either first end 305 or second end 310 in place using any suitable means, including, but not limited to, through the use of friction and/or clamping. First holder 315 and second holder 320 may be any suitable shape that creates a seal between ballistic apparatuses (e.g., first ballistic apparatus 170*a* and second ballistic apparatus 170*b* on FIG. 4) to protect detonation transfer line 180 from the external environment. Without limitation, a suitable shape may be circular, elliptical, triangular, rectangular, square, hexagonal and/or any combination thereof. First holder 315 and second holder 320 may include any suitable materials. Without limitation, suitable materials may be metals, polymers, rubbers, composites and/or any combination thereof. At least a portion of first holder 315 and second holder 320 may be covered by shroud 325.

Shroud 325 may surround the at least a portion of detonation transfer line 180. Shroud 325 may create an annulus of empty space around the at least a portion of detonation transfer line 180. Shroud 325 may create this annulus by sealing around at least a portion of first holder 315 and second holder 320. As illustrated, crimp seals 335 may be used to create seals between first holder 315 and shroud 325 and between second holder 320 and shroud 325 and secure shroud 325 to the first holder 315 and/or second holder 320. Any of a variety of suitable crimp seals 335 may be used, including, but not limited to, an annular piece (e.g., metal) compressed onto shroud 325 to create the seal. While crimp seals 335 are shown on FIG. 3, other suitable techniques may be used forming seals between shroud 325 and first and second holders 315, 320, including, but not limited to, O-rings, retaining rings, threads and/or any combination thereof. Shroud 325 may be any suitable length that may cover the at least a portion of detonation transfer line 180. Without limitation, the length of shroud 325 may be from a few inches to a few feet. For example, the length may be about 2 inches (8 cm) to about 5 feet (1.5 m), about 6 inches (15 cm) to about 3 feet (91 cm), or about 1 foot (30 cm) to about 3 feet (91 cm). Shroud 325 may be any suitable shape. Without limitation, a suitable shape may include a cross sectional shape that may be circular, elliptical, triangular, rectangular, square, hexagonal and/or any combination thereof. Shroud 325 may include any suitable materials that are flexible to allow tolerance between the ballistic apparatuses and/or stiff enough to provide strength to ballistic transfer apparatus 175. In other embodiments, shroud 325 may include a combination of stiff material segments with flexible couplings or flexible material segments with stiff couplings. Without limitation, suitable materials may include metals, polymers, rubbers, composites and/or any combination thereof. In embodiments, shroud 325 may include materials such as rubber, aluminum, steel and/or any combination thereof.

Figure 4:
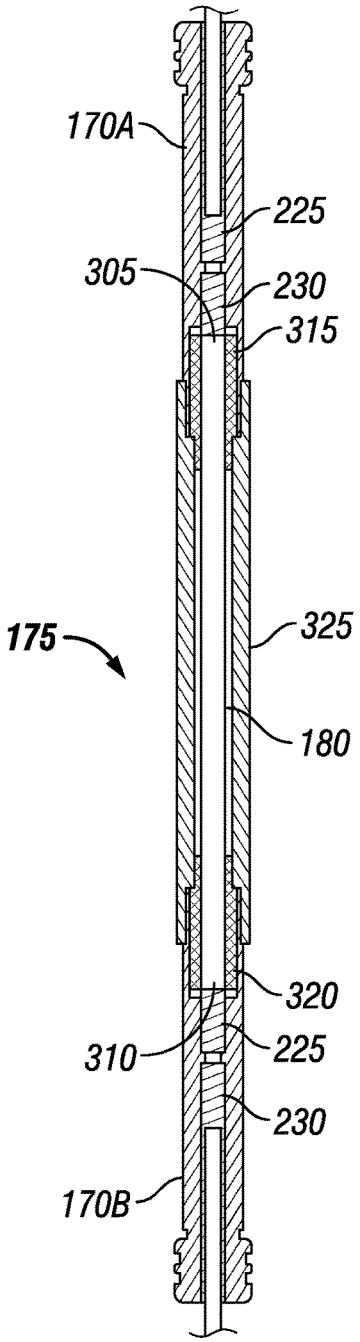
FIG. 4 illustrates an embodiment of a ballistic transfer apparatus disposed between ballistic apparatuses.

FIG. 4 illustrates an embodiment of ballistic transfer apparatus 175 disposed between a first ballistic apparatus 170*a* and a second ballistic apparatus 170*b*. Without limitation, ballistic transfer apparatus 175 may be disposed between first ballistic apparatus 170*a* and second ballistic apparatus 170*b* in a plurality of ways. In embodiments, ballistic transfer apparatus 175 may be disposed within or around the ballistic apparatuses, so long as acceptor booster 230 at first end 305 abuts donor booster 225 in first ballistic apparatus 170*a* and donor booster 225 at second end 310 abuts acceptor booster 230 in second ballistic apparatus 170*b*. In embodiments, donor booster 225 and acceptor booster 230 may be interchangeable, as may first end 305 with second end 310. Shroud 325 may surround at least a portion of detonation transfer line 180 and create a seal by being disposed on first holder 315 and second holder 320. Without limitation, each end of shroud 325 may seal around first holder 315 and second holder 320 through the use of crimp seals, O-rings, retaining rings, threads and/or any combination thereof. As illustrated, crimp seals 335 may form seals between shroud 325 and first holder 315 and between shroud 325 and second holder 320. There may be threads or locations for fasteners on the outside of first holder 35 and second holder 320 in order that shroud 325 may be secured.

Figure 5:
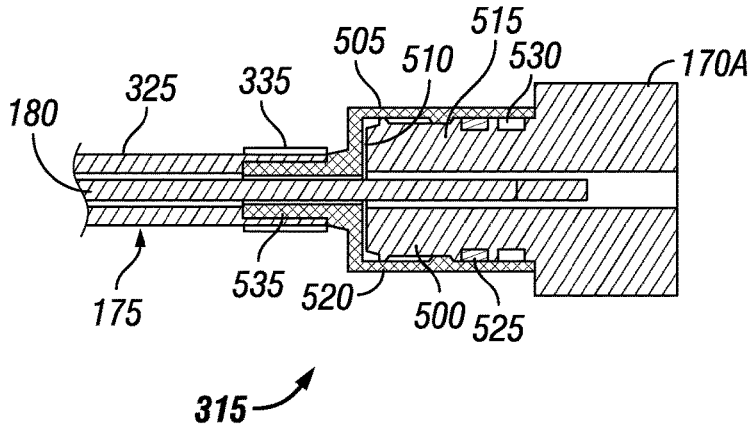
FIG. 5 illustrates an embodiment of a ballistic transfer apparatus showing connection to a ballistic apparatus.
Figure 6:
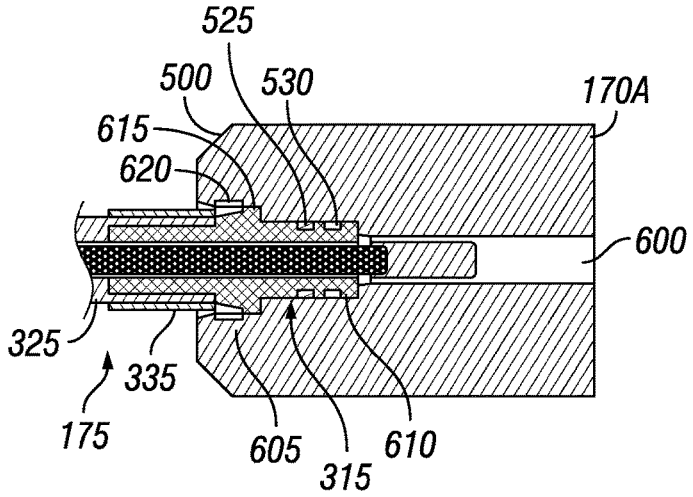
FIG. 6 illustrates another embodiment of a ballistic transfer apparatus showing connection to a ballistic apparatus.

Any of a variety of different suitable techniques may be used for coupling the first holder 315 and second holder 320 to the ballistic apparatuses, such as first ballistic apparatus 170*a* and second ballistic apparatus 170*b*, as shown on FIG. 4, for example. FIGS. 5 and 6 illustrate two different configurations for the first holder 315 and second holder 320 that may be used in connection with present embodiments. For simplicity, the following description on FIGS. 5 and 6 only references the first holder 315, but it should be understood that the configuration shown is equally applicable to the second holder 320.

FIG. 5 illustrates one technique for securing ballistic transfer apparatus 175 to first ballistic apparatus 170*a* in which first ballistic apparatus 170*a* is shown disposed in first holder 315. First holder 315 may be manufactured as a different half of a pair of mating connectors. FIG. 5 illustrates first holder 315 serving as the female connector because it is acting as a receptacle for the distal end 500 of first ballistic apparatus 170*a*. As illustrated, first holder 315 may have an enlarged end 505 that forms a receptacle 510 into which distal end 500 of first ballistic apparatus 170*a* may be disposed. Without limitation, first holder 315 may be disposed around first ballistic apparatus 170*a* to form a seal through the use of crimp seals, O-rings, retaining rings, threading, adhesives, welding and/or any combination thereof. As illustrated, threads 515 on first holder 315 may interact with threads 520 on distal end 500 of first ballistic apparatus 170*a* to secure the first holder 315 to first ballistic apparatus 170*a*. In addition, one or more O-rings 525 may be disposed in channels 530 in first holder 315, for example, to form a seal. As illustrated, shroud 325 may be secured to first holder 315. As illustrated, shroud 325 may be secured to extension 535 from enlarged end 505. Furthermore, without limitation, shroud 325 may be disposed around first holder 315 through the use of crimp seals, O-rings, retaining rings, threading, adhesives, welding and/or any combination thereof. As illustrated, crimp seal 335 may secure shroud 325 to first holder 315. Ballistic transfer apparatus 175 may be long enough to cover the entire length and/or at least a portion of detonation transfer line 180.

FIG. 6 illustrates another technique for securing ballistic transfer apparatus 175 to first ballistic apparatus 170*a* in which first holder 315 is shown disposed in first ballistic apparatus 170*a*. As illustrated, distal end 500 of first ballistic apparatus 170*a* may be disposed around first holder 315. The distal end 500 may be considered a female connector because it is acting as a receptacle for the first holder 315. As illustrated, channel 600 through first ballistic apparatus

170*a* may include an enlarged portion 605 at distal end 500. First holder 315 may be disposed in the enlarged portion 605 as shown on FIG. 6. As illustrated, first holder 315 may include a nose portion 610 that extends into the enlarged portion 605. One or more O-rings 525 may be disposed in channels 530 on the nose portion 610, for example, to form a seal. Retaining ring 620 may be used to secure first holder 315 in first ballistic transfer apparatus 170*a*. As illustrated, retaining ring 620 may be disposed on a shoulder portion 615 of first holder 315. While FIG. 6 illustrates use of one or more O-rings 525 and retaining ring 620, it should be understood that any suitable technique may be used to secure the ballistic transfer apparatus 175 to first ballistic apparatus 170*a* and form a seal. Without limitation, first holder 315 may be disposed within first ballistic apparatus 170*a* through the use of crimp seals, O-rings 525, retaining rings 620, threading, adhesives, welding and/or any combination thereof. Furthermore, without limitation, shroud 325 may be disposed around a portion of first holder 315 that may protrude from first ballistic apparatus 170*a* through the use of crimp seals, O-rings, retaining rings, threading, adhesives, welding and/or any combination thereof. As illustrated, crimp seal 335 may secure shroud 325 to first holder 315. Ballistic transfer apparatus 175 may be long enough to cover the entire length and/or at least a portion of detonation transfer line 180.

The systems and methods may include any of the various features of the systems and methods disclosed herein, including one or more of the following statements.

Statement 1. A ballistic transfer apparatus, the apparatus including: a detonation transfer line, wherein the detonation transfer line includes a first end and a second end; a first holder in engagement with the first end of the detonation transfer line to retain the detonation transfer line in the ballistic transfer apparatus; a second holder in engagement with the second end of the detonation transfer line to retain the detonation transfer line in the ballistic transfer apparatus; and a shroud extending between the first holder and the second holder that covers the detonation transfer line.

Statement 2. The ballistic transfer apparatus of statement 1, wherein the detonation transfer line includes an elongated body portion, an acceptor booster at the first end, and a donor booster at the second end.

Statement 3. The ballistic transfer apparatus of statement 1 or 2, wherein the detonation transfer line is selected from the group consisting of a detonation cord, a shock tube, a detonating fuse, and combinations thereof.

Statement 4. The ballistic transfer apparatus of any preceding statement, wherein the first holder is in a form of a male connector that includes a nose operable to extend into a ballistic apparatus.

Statement 5. The ballistic transfer apparatus of any preceding statement, wherein the first holder is in a form of a female connector that includes an enlarged portion that forms a receptacle operable to receive a distal end of a ballistic apparatus.

Statement 6. The ballistic transfer apparatus of any preceding statement, further including crimp seals that secure the shroud to the first holder and the shroud to the second holder.

Statement 7. The ballistic transfer apparatus of any preceding statement, further including O-rings disposed in channels on the first holder and the second holder.

Statement 8. A ballistic system, the system including: a first ballistic apparatus; a second ballistic apparatus; and a ballistic transfer apparatus, wherein the ballistic transfer apparatus couples the first ballistic apparatus to the second ballistic apparatus, and wherein the ballistic transfer apparatus includes: a detonation transfer line operable to transfer detonation from the first ballistic apparatus to the second ballistic apparatus, wherein the detonation transfer line includes a first end and a second end; a first holder that secures the ballistic transfer apparatus to the first ballistic apparatus, wherein the first holder is in engagement with the first end of the detonation transfer line; a second holder that secures the ballistic transfer apparatus to the second ballistic apparatus, wherein the second holder is in engagement with the first end of the detonation transfer line; and a shroud extending between the first holder and the second holder that covers the detonation transfer line.

Statement 9. The ballistic system of statement 8, wherein the detonation transfer line includes an elongated body portion, an acceptor booster at the first end, and a donor booster at the second end.

Statement 10. The ballistic system of statement 8 or 9, wherein the detonation transfer line is selected from the group consisting of a detonation cord, a shock tube, a detonating fuse, and combinations thereof.

Statement 11. The ballistic system of any one of statements 8 to 10, wherein the first holder is in a form a male connector that includes a nose that extends into an enlarged portion of a channel that extends through the first ballistic apparatus.

Statement 12. The ballistic system of any one of statements 8 to 11, wherein the first holder is in a form of a female connector that includes an enlarged portion that forms a receptacle operable to receive a distal end of the first ballistic apparatus.

Statement 13. The ballistic system of any one of statements 8 to 12, wherein the first holder includes threads that engage threads on a distal end of the first ballistic apparatus.

Statement 14. The ballistic system of any one of statements 8 to 13, further including crimp seals that secure the shroud to the first holder and the shroud to the second holder.

Statement 15. A method for coupling ballistic apparatuses, the method including: attaching a first holder of a ballistic transfer apparatus to a first ballistic apparatus such that a first end of a detonation transfer line in the ballistic transfer apparatus abuts a donor booster in the first ballistic apparatus; and attaching a second holder of the ballistic transfer apparatus to a second ballistic apparatus such that a second end of the detonation transfer line in the ballistic transfer apparatus abuts an acceptor booster in the second ballistic apparatus; wherein a shroud extends between the first holder and the second holder to cover the detonation transfer line.

Statement 16. The method of statement 15, wherein the attaching the first holder of the ballistic transfer apparatus to the first ballistic apparatus occurs by connecting the first holder around a portion of the first ballistic apparatus.

Statement 17. The method of statement 15 or 16, wherein the attaching the second holder of the ballistic transfer apparatus to the second ballistic apparatus occurs by connecting the second holder around a portion of the second ballistic apparatus.

Statement 18. The method of any one of statements 15 to 17, wherein the attaching the first holder of the ballistic transfer apparatus to the first ballistic apparatus occurs by disposing a nose of the first holder within the first ballistic apparatus.

Statement 19. The method of any one of statements 15 to 18, wherein the attaching the second holder of the ballistic transfer apparatus to the second ballistic apparatus occurs by disposing a nose of the second holder within the second ballistic apparatus.

Statement 20. The method of any one of statements 15 to 19, wherein crimp seals secure the shroud to the first holder and the shroud to the second holder.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A ballistic transfer apparatus, comprising:

a detonation transfer line, wherein the detonation transfer line comprises a first end and a second end;

a first holder in engagement with the first end of the detonation transfer line to retain the detonation transfer line in the ballistic transfer apparatus;

a second holder in engagement with the second end of the detonation transfer line to retain the detonation transfer line in the ballistic transfer apparatus; and a shroud extending between the first holder and the second holder that covers the detonation transfer line.

2. The ballistic transfer apparatus of claim 1, wherein the detonation transfer line comprises an elongated body portion, an acceptor booster at the first end, and a donor booster at the second end.

3. The ballistic transfer apparatus of claim 1, wherein the detonation transfer line is selected from the group consisting of a detonation cord, a shock tube, a detonating fuse, and combinations thereof.

4. The ballistic transfer apparatus of claim 1, wherein the first holder is in a form of a male connector that comprises a nose operable to extend into a ballistic apparatus.

5. The ballistic transfer apparatus of claim 1, wherein the first holder is in a form of a female connector that comprises an enlarged portion that forms a receptacle operable to receive a distal end of a ballistic apparatus.

6. The ballistic transfer apparatus of claim 1, further comprising crimp seals that secure the shroud to the first holder and the shroud to the second holder.

7. The ballistic transfer apparatus of claim 1, further comprising O-rings disposed in channels on the first holder and the second holder.

8. A ballistic system, comprising:

a first ballistic apparatus;

a second ballistic apparatus; and a ballistic transfer apparatus, wherein the ballistic transfer apparatus couples the first ballistic apparatus to the second ballistic apparatus, and wherein the ballistic transfer apparatus comprises:

a detonation transfer line operable to transfer detonation from the first ballistic apparatus to the second ballistic apparatus, wherein the detonation transfer line comprises a first end and a second end;

a first holder that secures the ballistic transfer apparatus to the first ballistic apparatus, wherein the first holder is in engagement with the first end of the detonation transfer line;

a second holder that secures the ballistic transfer apparatus to the second ballistic apparatus, wherein the second holder is in engagement with the first end of the detonation transfer line; and a shroud extending between the first holder and the second holder that covers the detonation transfer line.

9. The ballistic system of claim 8, wherein the detonation transfer line comprises an elongated body portion, an acceptor booster at the first end, and a donor booster at the second end.

10. The ballistic system of claim 8, wherein the detonation transfer line is selected from the group consisting of a detonation cord, a shock tube, a detonating fuse, and combinations thereof.

11. The ballistic system of claim 8, wherein the first holder is in a form a male connector that comprises a nose that extends into an enlarged portion of a channel that extends through the first ballistic apparatus.

12. The ballistic system of claim 8, wherein the first holder is in a form of a female connector that comprises an enlarged portion that forms a receptacle operable to receive a distal end of the first ballistic apparatus.

13. The ballistic system of claim 8, wherein the first holder comprises threads that engage threads on a distal end of the first ballistic apparatus.

14. The ballistic system of claim 8, further comprising crimp seals that secure the shroud to the first holder and the shroud to the second holder.

15. A method for coupling ballistic apparatuses, comprising:

attaching a first holder of a ballistic transfer apparatus to a first ballistic apparatus such that a first end of a detonation transfer line in the ballistic transfer apparatus abuts a donor booster in the first ballistic apparatus; and attaching a second holder of the ballistic transfer apparatus to a second ballistic apparatus such that a second end of the detonation transfer line in the ballistic transfer apparatus abuts an acceptor booster in the second ballistic apparatus;

wherein a shroud extends between the first holder and the second holder to cover the detonation transfer line.

16. The method of claim 15, wherein the attaching the first holder of the ballistic transfer apparatus to the first ballistic apparatus occurs by connecting the first holder around a portion of the first ballistic apparatus.

17. The method of claim 16, wherein the attaching the second holder of the ballistic transfer apparatus to the second ballistic apparatus occurs by connecting the second holder around a portion of the second ballistic apparatus.

18. The method of claim 15, wherein the attaching the first holder of the ballistic transfer apparatus to the first ballistic apparatus occurs by disposing a nose of the first holder within the first ballistic apparatus.

19. The method of claim 18, wherein the attaching the second holder of the ballistic transfer apparatus to the second ballistic apparatus occurs by disposing a nose of the second holder within the second ballistic apparatus.

20. The method of claim 15, wherein crimp seals secure the shroud to the first holder and the shroud to the second holder.

* * * * *